United States Patent [19]

Van de Pol

[11] Patent Number: 4,820,218

[45] Date of Patent: Apr. 11, 1989

[54] SWIM FIN

[75] Inventor: Herbert D. Van de Pol, Riviera Beach, Fla.

[73] Assignee: Wenoka Seastyle, West Palm Beach, Fla.

[21] Appl. No.: 131,573

[22] Filed: Dec. 11, 1987

[51] Int. Cl.[4] ..... A63B 31/08

[52] U.S. Cl. ..... 441/64

[58] Field of Search ..... 441/61, 64; D21/239

[56] References Cited

FOREIGN PATENT DOCUMENTS

| | | | |
|---|---|---|---|
| 1078913 | 3/1960 | Fed. Rep. of Germany | 441/64 |
| 1344379 | 10/1963 | France | 441/64 |
| 323623 | 1/1936 | Italy | 441/64 |
| 511942 | 6/1958 | Italy | 441/64 |
| 1117067 | 10/1984 | U.S.S.R. | 441/64 |

*Primary Examiner*—Sherman D. Basinger
*Assistant Examiner*—Jesûs D. Sotelo
*Attorney, Agent, or Firm*—Wolf, Greenfield & Sacks

[57] ABSTRACT

A swim fin having an elongated flexible blade. The blade has elongated tapered sleeves to hold elongated tapered battens. The battens selectively stiffening the blade to achieve varying degrees of stiffness according to the wear's strength. Each batten has a tab to function to prevent the batten from sliding entirely within the sleeve and to function as a grip for easy removal of the batten from the sleeve. Additionally, the fin has ribs with concave outer walls which assist in the smooth flexing of the fins when used.

5 Claims, 3 Drawing Sheets

28
26
28
52
42
4
40
14
1
6

26
4
4
52
20
30
30
4
14
6

2
8
10
12
14
16
18
20
22
30
34
36
38
52
5
5

SWIM FIN

BACKGROUND OF THE INVENTION

Swim fins have long been used for skin diving, scuba diving, and other recreational and nonrecreational uses in order to create greater propulsive forces than can be accomplished by the foot alone. A swim fin generally consists of a portion for securing the fin to the users foot as well as a web or blade that is supported to extend from the front part of the foot for assisting in propulsion.

The stiffness of the blade or web of swim fins relates to the energy needed for proper operation of the blade. The more flexible the blade, the less energy and strength required for that particular pair of fins. However, the more flexible the blade, the slower the speed that is achievable. For that reason, beginner swimmers or swimmers having limited physical strength should ordinarily choose swim fins with more flexible blades. On the other hand, as the swimmer's strength increases, swim fins with stiffer blades should be used to achieve maximum speed and efficiency.

In addition, swimmers using swim fins for prolonged time periods tire. Under those circumstances, it is desirable to use swim fins with greater flexibility as the use of the fins continue over a prolonged time period.

Heretofore, the only solution commonly available to a swimmer wishing to change the stiffness of the swim fins being used is simply to substitute a swim fin with stiffer blades.

As a result, swimmers have often used swim fins that are much too stiff for them in the hope that with continued use and practice, and consequent pain and discomfort, the swimmer would be accustomed to the stiffer swim fin.

Existing swim fins conventionally include side ribs which have outerwalls that are either convex or lie in a plane perpendicular to the plane of the web. These ribs may bend or collapse over the surface of the web when the fin is flexed. If so, the flexing or bending of the fin is not smooth and the efficiency of the fin is impaired.

Insofar as the applicant is aware, there have been no direct efforts to solve this problem, although there have been several designs of swim fins having reinforcing elements within the blade for a variety of purposes. Thus, for example, the applicant is aware of U.S. Pat. Nos. 4,007,506 issued Feb. 15, 1977, 3,649,979 issued Mar. 21, 1972, 3,913,158 issued Oct. 21, 1975, 4,083,071 issued Apr. 11, 1978, 3,055,025 issued Sept. 25, 1962 and 4,627,820 issued Dec. 9, 1986. While each of these patents relate to swim fins, and to various treatments of the blade or web, none of them appear to deal directly with the problem of providing a blade with adjustable or variable stiffness.

SUMMARY OF THE INVENTION

It is accordingly, an object of the present invention to provide an improved swim fin designed for adjustable flexibility whereby a swimmer may selectively adjust the stiffness of the blade, thus permitting more or less energy to be used.

A further object of the present invention is to provide an improved swim fin having adjustably flexible blades shaped in such a fashion as to permit easy adjustment by the swimmer of the flexibility with a variety of flexible stiffnesses being available.

A further object of the present invention is to provide an improved swim fin construction having an adjustable blade which permits immediate adjustments to the overall tension and stiffness of the blade, depending upon the specific and current requirements of the user.

A further object of the present invention is to provide a means by which a novice or beginning diver or swimmer, or a swimmer who has been active for a prolonged period of time can progressively increase the strength of the swimmer's underwater kicks while maximizing propulsion achievable at the particular skill and strength level of the swimmer at that particular time.

A further object of the present invention is to provide an improved swim fin construction that minimizes the likelihood of cramps and fatigue by a diver as a result of overtiring the diver's calfs and feet.

A further object of the present invention is to provide an adjustable swim fin arrangement that may be customized to a particular swimmer's strength, and in which stiffness of one fin of a pair may be varied from the stiffness of the other pair for use by swimmer's having legs of unequal strength.

Another object of this invention is to provide a swim fin having a web bordered by ribs that are shaped to compress outwardly, thereby improving the dynamics and efficiency of the fin.

The foregoing objects and advantages of the present invention are achieved by a swim fin having an elongated flexible blade in which the blade has a plurality of sleeves extending lengthwise of the blade and open at one end to receive battens. In a preferred embodiment, three such sleeves are provided. A plurality of elongated battens that are tapered from one end to the other are shaped to be inserted into the sleeves for selective stiffening of the blade. In the preferred embodiment, the battens each have tabs at one end. In use, the fin may be used with one, two or three battens fully inserted. In a modification, battens shorter than the length of the sleeve may also be used for further adjustability.

DETAILED DESCRIPTION OF THE DRAWINGS

The foregoing objects and advantages of the present invention will be more clearly understood when considered in conjunction with accompanying drawings in which.

DETAILED DESCRIPTION OF THE PREFERRED EMBODIMENT

Figure 1:
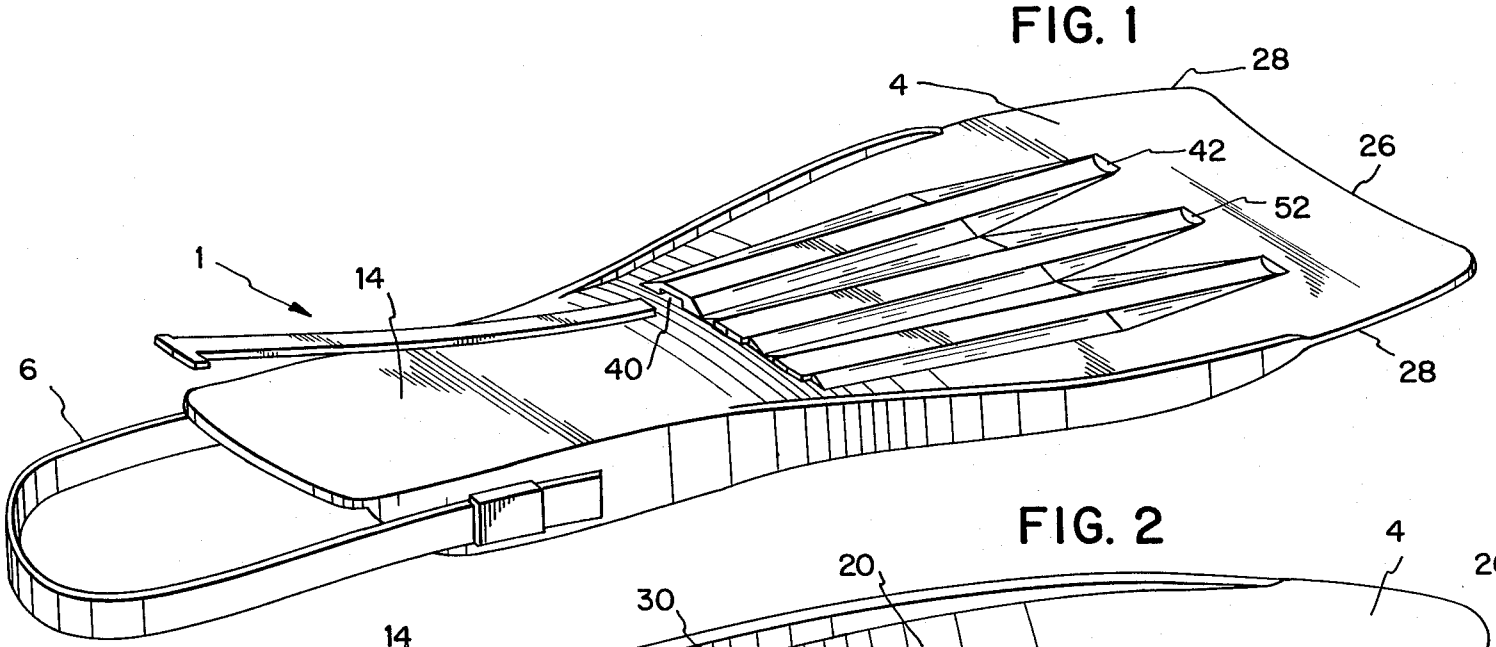
FIG. 1 is a bottom perspective view of a swim fin embodying the present invention with one batten positioned for insertion and the other two battens fully inserted.

Referring now to the drawing, there is illustrated a swim fin 1 preferably made of elastomeric or synthetic rubber material adapted to be secured to the foot 2 (FIG. 3) of a wearer. The fin consists of a flexible web or blade generally illustrated at 4 and means 6 for securing the web or blade to the wearer's foot. The means for securing the web or blade 4 to the wearer's foot consists of a foot portion 8 having a vamp 10 that is adapted to extend over the forepart of the wearer's foot with an opening 12 at the forward end through which the wearer's toes may extend if necessary. The lower edges of the vamp 10 are connected to the bottom 14 of the fin. An opening 16 in the foot portion 8 tapers to the narrow toe openings 12 and is shaped to receive the forepart of a wearer's foot. The bottom 14 extends forwardly into and is continuous with the web 20 forming the blade of the fin. The lower edges of the foot portion 8 are integrally formed with the side edges of bottom 14. A restraining strap 18 adapted to engage the heel of the wearer's foot is secured at one end to the vamp 10 with the other end adjustably secured to a conventional strap holder 2. The strap holder may be of any particular design commonly used for adjustably tightening or loosening the strap 18 about the wearer's foot.

Figure 2:
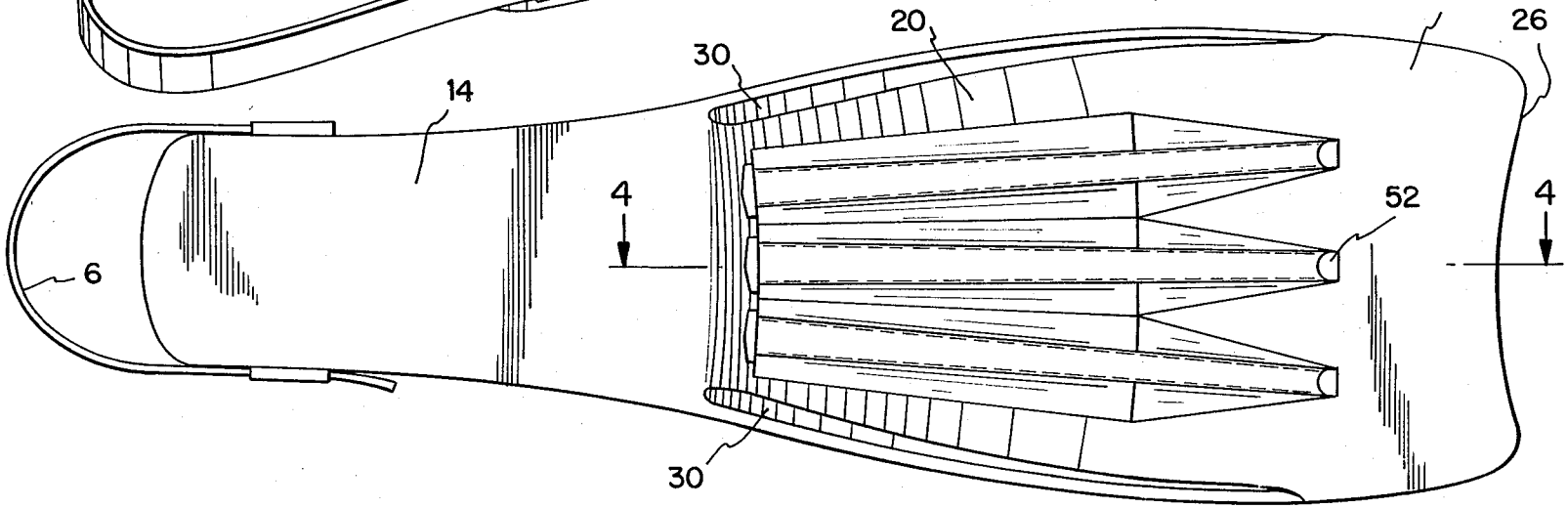
FIG. 2 is a bottom plan view of a swim fin embodying the present invention with three battens fully inserted.
Figures 3, 4, 5:
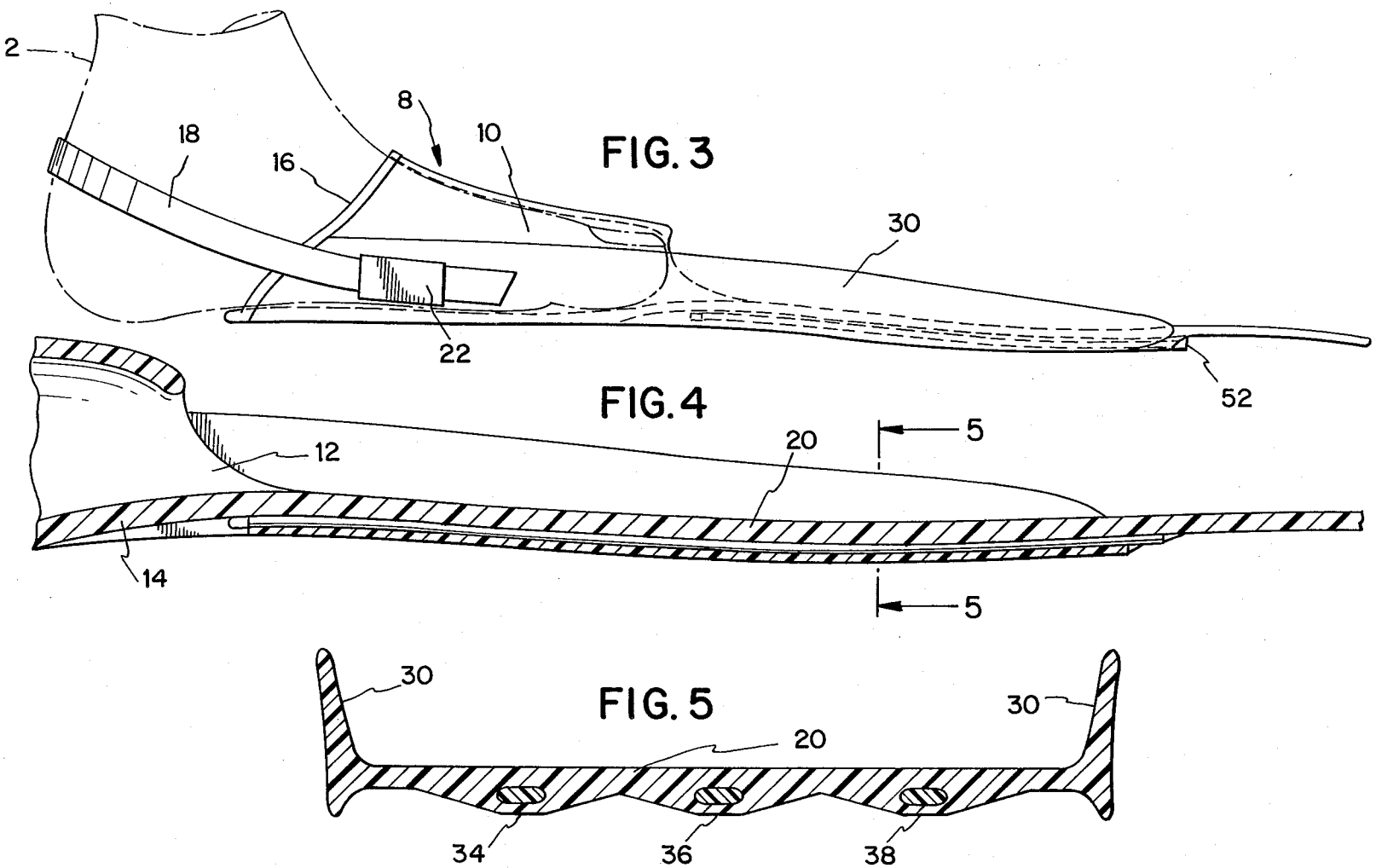
FIG. 3 is a side view of the swim fin of the present invention with a wearer's foot shown in dotted outline.
FIG. 4 is a cross sectional view taken along line 4—4 of FIG. 2.
FIG. 5 is a cross sectional view taken along line 5—5 of FIG. 4.

The web 20 flares forwardly through a forward end 26 with the sides 28 of the web preferably flared outwardly as illustrated in FIGS. 1 and 2. The web 20 preferably tapers somewhat from a relatively heavy or thick section under the wearer's foot to the end 26 where it may be tapered or feathered as desired. The side edges of the web 20 are provided with reinforcing ribs 30 that are thicker at the base adjacent the junction of the web 20 as illustrated in FIG. 5 and tapered to a narrow cross section at the free end. The ribs 30, as illustrated in FIG. 5, are flared slightly outwardly. The outer surface may be slightly concave. Thus, the outer surface may be concave in the order of 0.2" inwardly from a plane passing through the outer edges of the top and bottom of the ribs. The ribs 30 extend from the forward portion of the web, preferably more than half the length of the web, rearwardly to the foot engaging portion of the fin and provide a side stiffening means for the swim fin along a major portion of its length.

Figure 6:
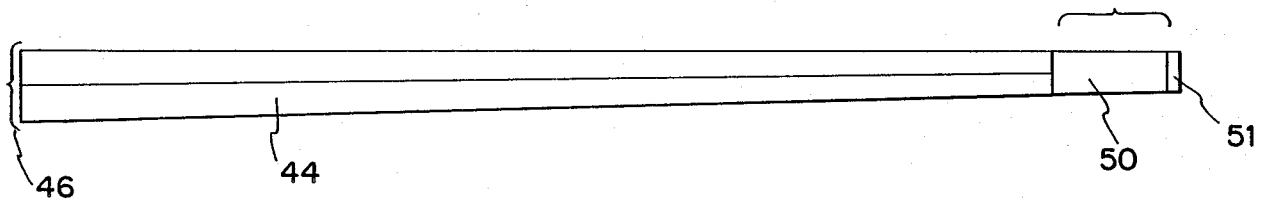
FIG. 6 is a plan view of a full length batten.

The web 20 is formed with preferably three sleeves 34, 36 and 38. These sleeves extend from a position approximately beneath the forward portion of the foot portion 8, the major length of the blade to a position preferably 80% of the length of the blade from the position in which the sleeves commence to the free end 26 of the blade. Each sleeve is integrally formed with the web 20 and preferably is formed with an open end 40, the rear end of the sleeve, and an open end 42 at the forward end of the sleeve. The sleeves 34, 36 and 38 are preferably tapered slightly from opening 40 to opening 42. Each of the sleeves 34, 36 and 38 are shaped and sized to receive a batten 44 illustrated in FIG. 6. The battens 44 are preferably made of a plastic elastomer, fiberglass, or stainless steel and are shaped to snugly fit within the sleeve when fully inserted and is provided with a tab 46 at its rear end adapted to prevent over insertion of the stay within the sleeve and to permit means for engaging the batten for removal. When fully inserted, each batten 44 preferably has a lip 51 at its forward end 50 projecting into the opening 42 with the lip 51 engaging a corresponding groove in the forward end of the sleeve, as illustrated in FIG. 1 and FIG. 2.

The battens 44 add stiffness to the fin. The fin will have the minimum desired stiffness with no battens and maximum desired stiffness when all battens are fully inserted.

In use, the swim fin of the present invention may be used to adjust stiffness of the fin for the particular swimmer involved. Using these swim fins, and in particular for underwater divers, the fin is used by a kicking action, the diver moves forwardly when the kinetic energy of a coiled fin blade is released behind the diver as the fin blade straightens out and thereby displaces water. The greater the stiffness available in the fin blade, the greater the rearward thrust there is to assist in moving the diver forwardly. However, as noted above, the stiffer the fin blade, the more physical strength required of the diver to effect bending.

Thus, in using the swim fins of the present invention, the novice diver or diver not in particularly in good condition, may adjust the stiffness of the blades by removing one or more battens. If desired, a combination of full and short length battens may be achieved. Thus, a beginner diver might conceivably use a swim fin with no battens and then gradually increase the stiffness by first using shortened battens and then one or two battens before achieving full stiffness with the insertion of three full length battens.

While the present invention in its preferred form contemplates the use of three sleeves for three battens, fewer or more sleeves and battens may be used.

The battens may if desired, be provided with friction engaging means for securing the batten within the sleeve when inserted. These friction engaging means may comprise one of several different forms. Thus, for example, a dimple may be provided in either the batten or the sleeve with a corresponding recess in the other component whereby the battens will snap and lock into place when inserted to a point in which the dimple and recess are aligned.

The concave surface of the outwardly flared ribs flex or cup outwardly when the fin is flexed or coiled. This results in a more functional movement of the fin with greater smoothness of operation and more efficient use of the energy transfer resulting from this movement.

Having described my invention, I claim:

1. A swim fin comprising:

an elongated flexible blade and an integrally formed foot portion formed in part by one end of said blade and a vamp on one side of said blade shaped to extend over the wearer's foot, said blade having a plurality of sleeves extending lengthwise of said blade and open and accessible at one end on the other side of said blade to receive battens, and a plurality of elongated battens wherein said battens are shaped to be inserted into said sleeves from the other side of said blade to selectively stiffen said blade.

2. A swim fin as set forth in claim 1, wherein said elongated battens are made of a flexible material that is less flexible than the material of which said blade is made and wherein said battens are tapered along their length and have means for removably securing said battens within said sleeves.

3. A swim fin as set forth in claim 2, wherein said means for removably securing battens comprises a tab at one end of each batten that limits insertion and facilitates removal of said batten.

4. A swim fin comprising an elongated flexible blade and an integrally formed foot portion formed in part by one end of said blade and a vamp shaped to extend over the forepart of the wearer's foot, said blade having a thickness that tapers from a thick cross section at said one end to a thinner cross section at the other end, said blade having reinforcing ribs extending longitudinally of and along a major portion of each side edge of the blade from said one end to said other end, said ribs being thicker in cross section at their lower longitudinal edges adjacent to said blade than at their upper longitudinal edges remote from said blade, said ribs flared angularly outwardly from a plane in which said blade lies and each having an outer concave surface.

5. A swim fin as set forth in claim 4 wherein said outer concave surface of said ribs are concave in the order of magnitude of 0.2″ inwardly from a plane passing through the outer edges of the top and bottom outer edges of said ribs.

* * * * *